US006494697B2

(12) United States Patent
Tagami

(10) Patent No.: US 6,494,697 B2
(45) Date of Patent: Dec. 17, 2002

(54) DRIVEN EQUIPMENT FOR FLUID MACHINERY

(76) Inventor: Masahiro Tagami, 123, Unumakawasakimachi 3-chome, Kagamihara-shi, Gifu, 509-0147 (JP)

( * ) Notice: Subject to any disclaimer, the term of this patent is extended or adjusted under 35 U.S.C. 154(b) by 0 days.

(21) Appl. No.: 09/967,588

(22) Filed: Sep. 29, 2001

(65) Prior Publication Data

US 2002/0021977 A1 Feb. 21, 2002

Related U.S. Application Data

(63) Continuation-in-part of application No. 09/580,039, filed on May 26, 2000, now Pat. No. 6,315,538.

(51) Int. Cl.[7] ..... F01C 1/00; F01C 19/00

(52) U.S. Cl. ..... 418/117; 418/150; 418/253; 418/270

(58) Field of Search ..... 418/117, 150, 418/253, 270

(56) References Cited

U.S. PATENT DOCUMENTS 716,970 A * 12/1902 Werner ..... 418/253
3,369,529 A * 2/1968 Jordan ..... 418/253
3,642,391 A * 2/1972 Wilson ..... 418/253
3,918,415 A * 11/1975 Ishida ..... 418/253

FOREIGN PATENT DOCUMENTS

DE 2336292 * 2/1975 ..... 418/270

* cited by examiner

*Primary Examiner*—John J. Vrablik
(74) *Attorney, Agent, or Firm*—Muramatsu & Associates

(57) ABSTRACT

A fluid machinery driven equipment such as a rotary pump has a simple structure and high efficiency with a small size and low cost. The driven equipment includes a tubular casing having an inner surface which is substantially elliptic in shape, a rotor provided in the tubular casing where the rotor having a first arm provided with a rotatable piston at its end and a second arm in perpendicular to the first arm provided with a rotary plate at its end, and a rotary shaft provided in the tubular casing and connected to the rotor where at least one end of the rotary shaft is projected from the tubular casing to be connected to the external force.

15 Claims, 11 Drawing Sheets

DRIVEN EQUIPMENT FOR FLUID MACHINERY

This is a continuation-in-part of U.S. patent application Ser. No. 09/580,039 filed May 26, 2000, U.S. Pat. No. 6,315,538.

FIELD OF THE INVENTION

This invention relates to a fluid machinery driven equipment that performs energy exchange between a rotary fluid machinery and fluid such as gas or liquid, and more particularly, to a driven equipment such as a rotary pump involving piston rotation in which an outer edge of the piston slides along an inner elliptical surface of the rotary pump to perform intake and exhaust actions.

BACKGROUND OF THE INVENTION

With continuing progress in science and technology, various types of fluid machinery driven equipment have been developed with improved performances. This invention is directed to a displacement type rotary driven equipment, such as a rotary pump, a rotary compressor, a gear pump, a scroll pump and the like.

Rotary driven equipment is widely used in the industry. However, rotary driven equipment of today is still inefficient in energy exchange and is complex in configuration. Further, because of the structural complexity, the physical size and cost of such rotary driven equipment is not small enough to be widely used in various applications.

SUMMARY OF THE INVENTION

Therefore, it is an object of the present invention to overcome the aforementioned problems and to provide a fluid machinery driven equipment having a simple structure and a high efficiency with a small size and low cost.

In the present invention, the driven equipment for fluid machinery which is driven by an external power includes a tubular casing having an inner surface which is substantially elliptic in shape, front and rear covers for covering the tubular casing through fastening means, a rotary shaft provided in the tubular casing and is supported by the front and rear covers where at least one end of the rotary shaft being projected from the cover to be connected to the external power, and a rotor provided in the tubular casing and connected to the rotary shaft.

The rotor is formed of a first arm extended from a center of the rotor to opposite directions, a piston rotatably connected to each end of the first arm through a piston pin and forming substantially a "T" shape with the first arm where the piston having an outwardly curved surface, and each end of the piston has an inwardly bent portion, a second arm extended from the center of the rotor to opposite directions in perpendicular to the first arm, a rotary plate provided at each end of the second arm and forming substantially a "T" shape where the rotary plate having an outwardly curved surface, and an inner surface at each end of the rotary plate is slidably contact with an outward surface of the inwardly bent portion of the piston, piston seals elastically formed on the piston at around both edges thereof for air tightly contacting the inner surface of the tubular casing, and a spring provided between the second arm and the piston for reducing frictional forces between the piston seals and the inner surface of the tubular casing.

The driven equipment further includes first openings provided on the tubular casing at two positions which are symmetrical with one another relative to the rotary shaft, and second openings provided on the covers at two positions which are symmetrical with one another relative to the rotary shaft and about 90 degrees apart from the first openings relative to the rotary shaft. When the first openings function as intake openings, the second openings function as exhaust openings, and vice versa.

In the driven equipment of the present invention, four spaces are created by the inner surface of the tubular casing and the rotor, two of which are spaces formed by the pistons at both ends of the first arm and the inner surface, and two other spaces are formed by the rotary plates at both ends of the second arm and the inner surface. The sizes of the four spaces change by rotation of the rotor, thereby performing an intake and exhaust actions for fluid.

In the driven equipment of the present invention, the elliptical shape of the inner surface of the tubular casing is determined by the following steps of:

(1) drafting a circuit K with a radius R1 with respect to a center O, where the center O corresponds to the center of the rotation shaft, (2) drafting a straight line AC which is tangential to the circuit K at a center E of the line AC, (3) extending a line EO and drafting an arc ABC with respect to a center J on the line EO with a radius R2, where a point B is a cross point of the line EO and the art ABC, (4) moving the point A of the straight line AC along the arc ABC to the point B in a manner that the center E moves along the circle K, and drafting the trace of the point C of the line AC to form a curve ABCD, and (5) defining an outer curve which is outwardly apart from the curve ABCD by a distance X, wherein the outer curve is the inner surface of the tubular casing, and the circle K is a trace of rotation of the piston pin and the curve ABCD is a reference casing curve.

In the further aspect of the present invention, the spring for reducing the friction between the piston seals and the inner surface of the tubular casing is obviated to promote energy conversion efficiency. Both of the intake and exhaust openings are provided on the tubular casing which are about 90 degrees apart from one another with respect to the rotation shaft. Seals are additionally provided between the rotary plates and the pistons.

BRIEF DESCRIPTION OF THE DRAWINGS

FIG. 1 includes a partially cut out view showing an inner structure of the fluid machinery driven equipment.

DETAILED DESCRIPTION OF THE INVENTION

The preferred embodiments of the present invention will now be explained with reference to the accompanying drawings. FIGS. 1–9 show a rotary driven equipment in the first embodiment of the present invention which is typically a rotary pump.

Figure 1:
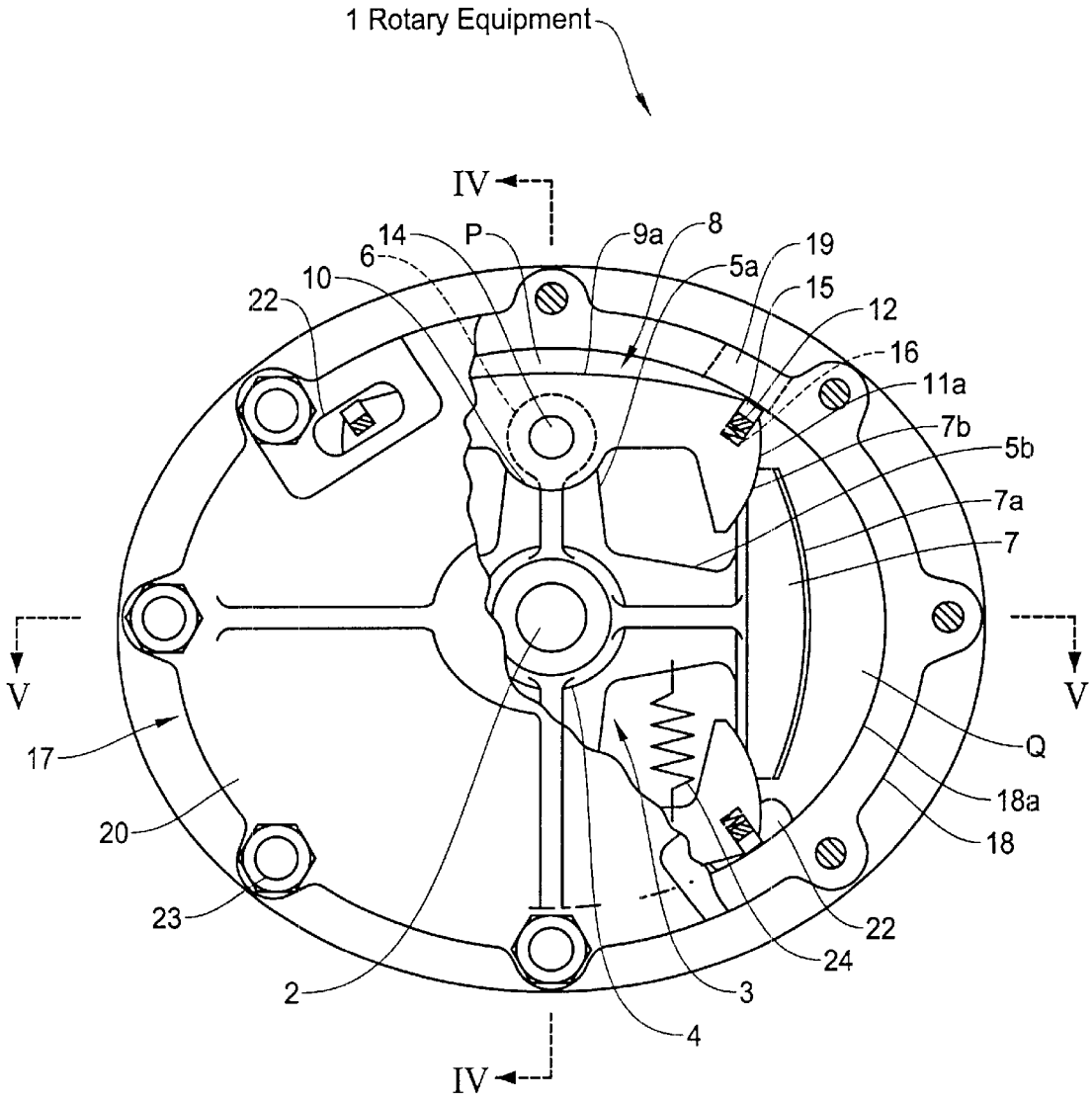
FIG. 1 is a front view of the fluid machinery driven equipment in the first embodiment of the present invention.
Figure 2:
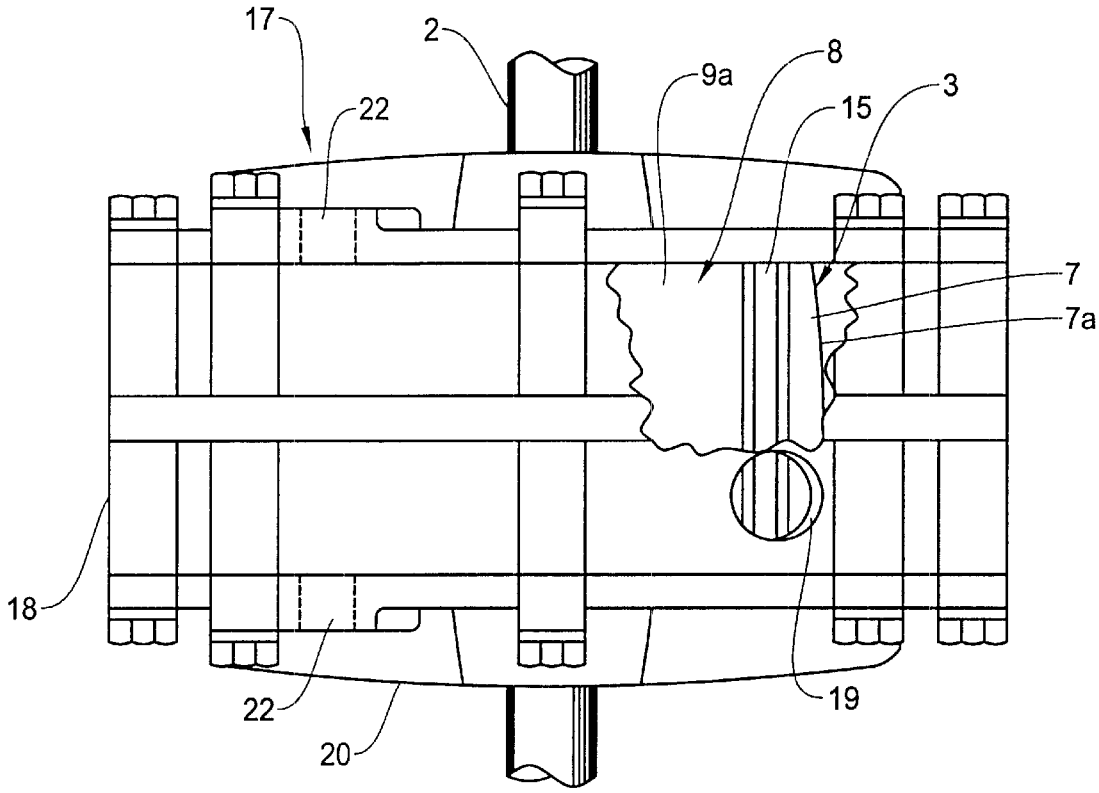
FIG. 2 is a plan view including a partially cut-out view of the fluid machinery driven equipment in the first embodiment of the present invention.
Figure 3:
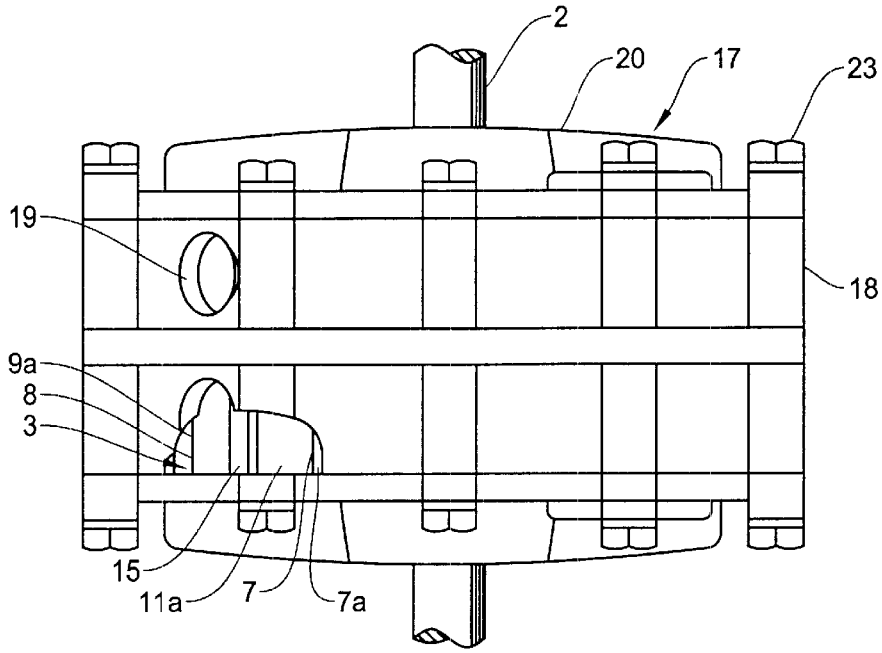
FIG. 3 is a right side view of the fluid machinery driven equipment in the first embodiment of the present invention which also includes a partially cut-out view showing an inner structure.
Figure 4:
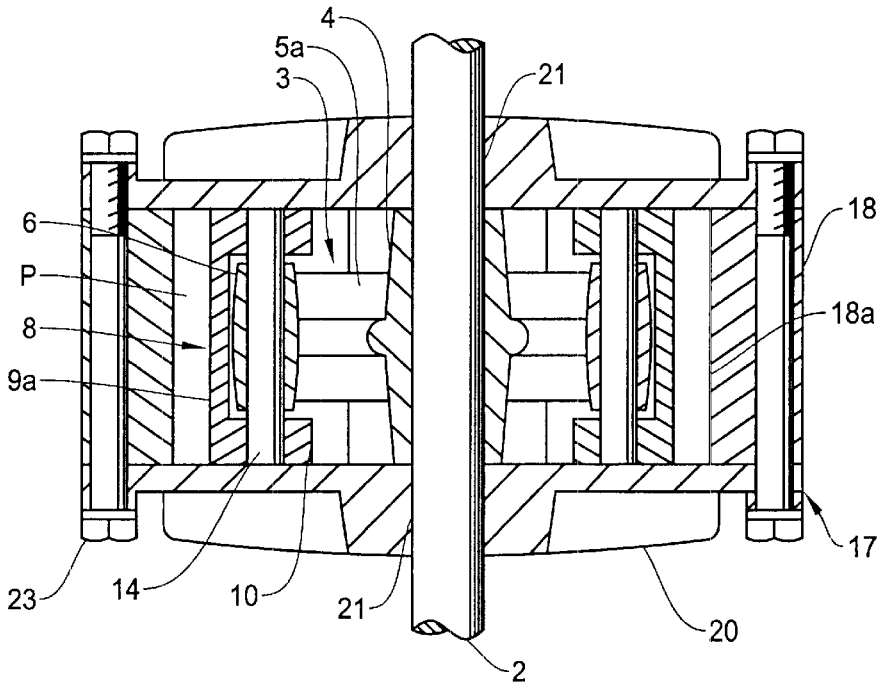
FIG. 4 is a cross sectional view of the fluid machinery driven equipment of the present invention taken along a line IV—IV of FIG. 1.
Figure 5:
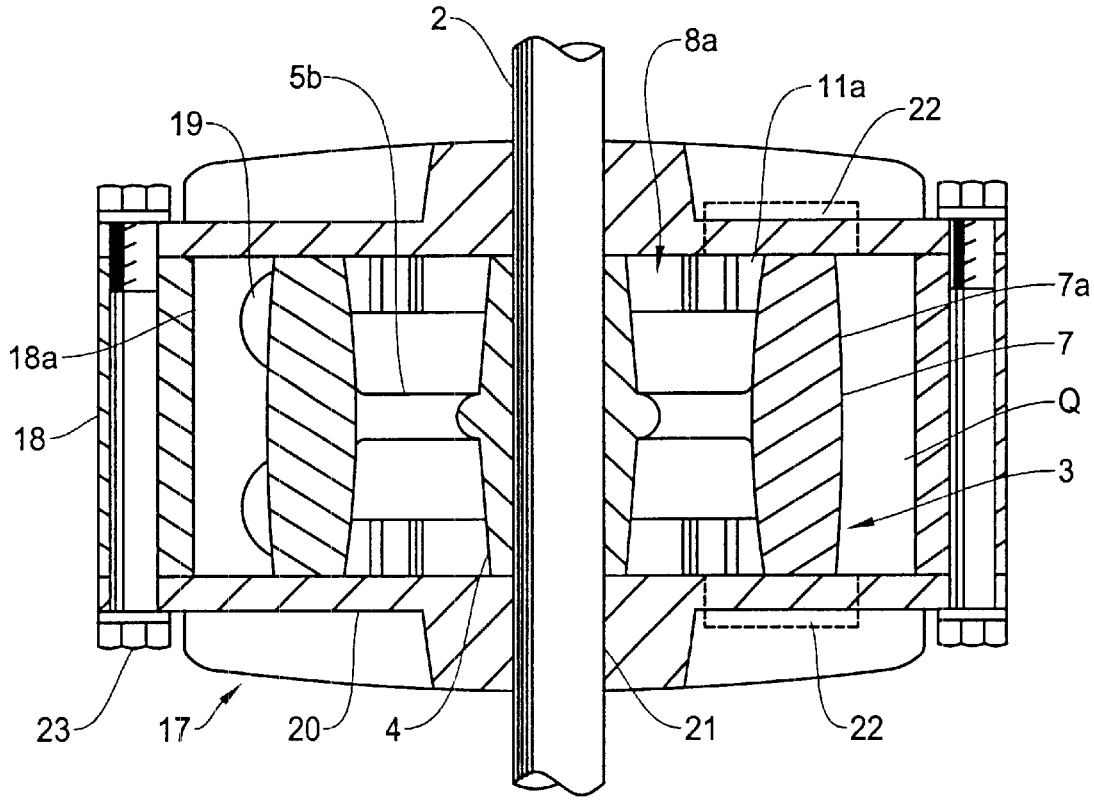
FIG. 5 is a cross sectional view of the fluid machinery driven equipment of the present invention taken along a line V—V of FIG. 1.

FIG. 1 is a front view of the rotary equipment 1 (17) having a tubular casing 18 with an inner surface 18*a*. In the center of the tubular casing 18, the rotary equipment 17 includes a rotary shaft 2 which is connected to a power transmission device (not shown) such as an engine or a motor. A rotor 3 is formed of a boss 4 fixedly connected to the rotary shaft 2 and two arms 5*a* and 5*b*. The arms 5*a* and 5*b* are projected in such a way as to form a cross shape with right angle at each two adjacent arms.

At the ends of the arms 5*a* (up and down direction of FIG. 1), tubular supports 6 are respectively provided. A piston 8 is connected to each end of the arm 5*a* through a pin receptacle 10 and a piston pin 14 in a manner rotatable about the piston pin 14. At the ends of the arm 5*b* (right and left direction of FIG. 1), rotary plates 7 are respectively provided.

As shown in FIG. 1, the arm 5*a* and the piston 8 form a "T" shape. Similarly, the arm 5*b* and the rotary plate 7 also form a "T" shape. An outer surface 9*a* of the piston 8 and an outer surface 7*a* of the rotary plate 7 are outwardly curved in a small degree. Both ends of the piston 8 are inwardly bent to form curved outer surfaces (slide surfaces 11*a*). Each of the slide surfaces 11*a* contacts a respective end (slide surface 7*b*) of the rotary plate 7.

Thus, the pistons 8 and the rotary plates 7 form a closed square space around the rotary shaft 2. Since the piston 8 is rotatable about the piston pin 14 in the tubular support 6, the slide surface 11*a* of the piston 8 and the slide surface 7*b* of the rotary plate 7 slide with each other depending on the angle of rotation of the rotary shaft 2. The details of this operation will be explained later.

A groove 12 is provided at each end of the curved surface 9*a* of the piston 8, i.e, at about the corner of the bent portion of the piston 8. An elastic member 16 is inserted in the groove 16 over which a piston seal 15 is further inserted in the groove 16. Because of the spring force of the elastic member 16, the piston seal 15 is pressed outwardly to keep contacting the inner surface 18*a* of the tubular casing 18. The groove 12 is extended in a direction perpendicular to the paper of FIG. 1, i.e., from front to rear. Thus, the piston seal 15 is mounted on the piston 8 in a manner shown in the plan view of FIG. 2 and right side view of FIG. 3.

As shown in FIG. 1, the tubular casing 18 and the inner surface 18*a* thereof have an oval shape so that the diameter in the right/left direction is larger than that of the up/down direction. Therefore, in FIG. 1, the inner spaces Q in the right and left positions in the rotary pump 17 are greater than the spaces P in the up and down positions therein.

Figure 7:
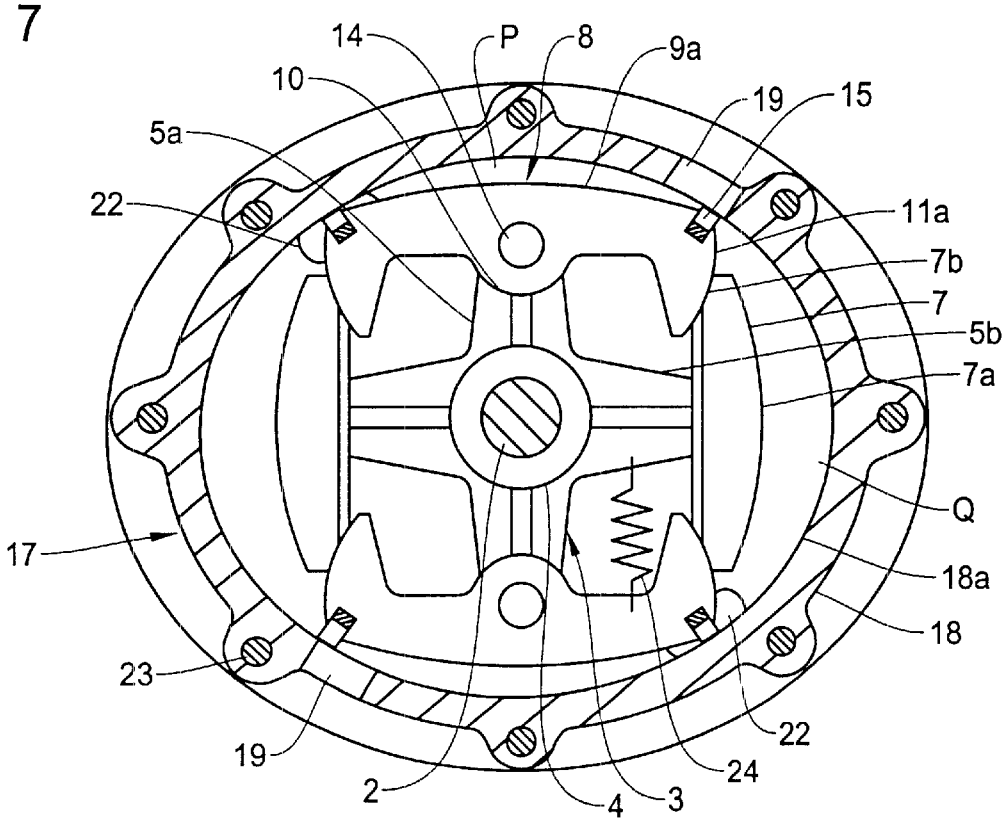
FIG. 7 is a diagram showing an inner state of the fluid machinery driven equipment of the present invention where two pistons are in top and bottom positions and in substantially horizontal directions.
Figure 8:
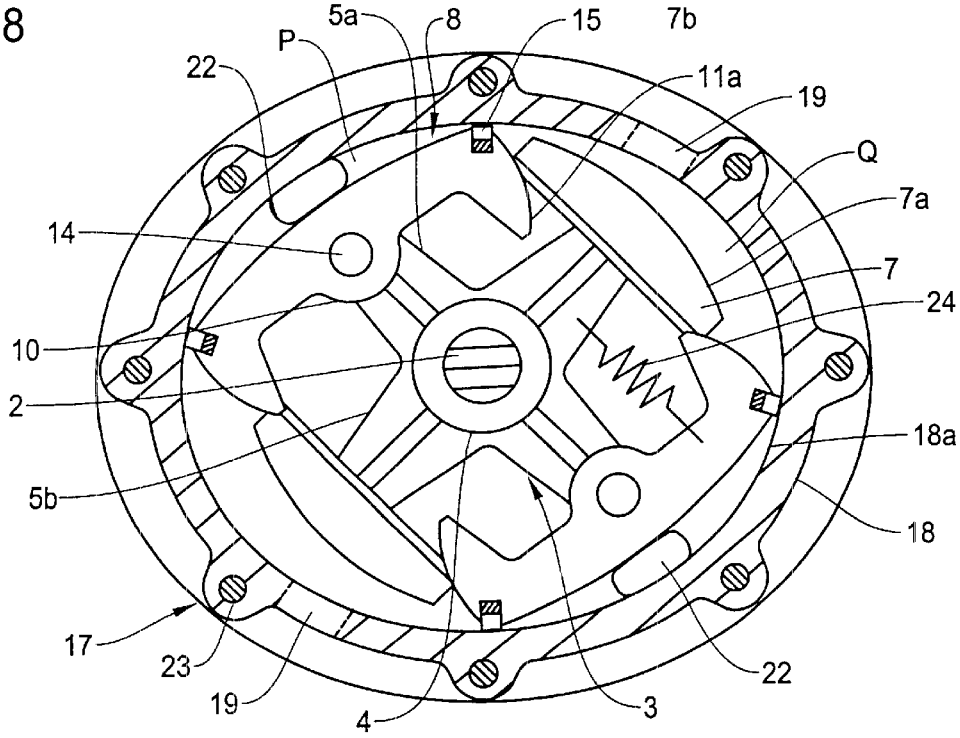
FIG. 8 is a diagram showing an inner state of the fluid machinery driven equipment of the present invention where the driven equipment is rotated by 45 degrees from the condition of FIG. 7.
Figure 9:
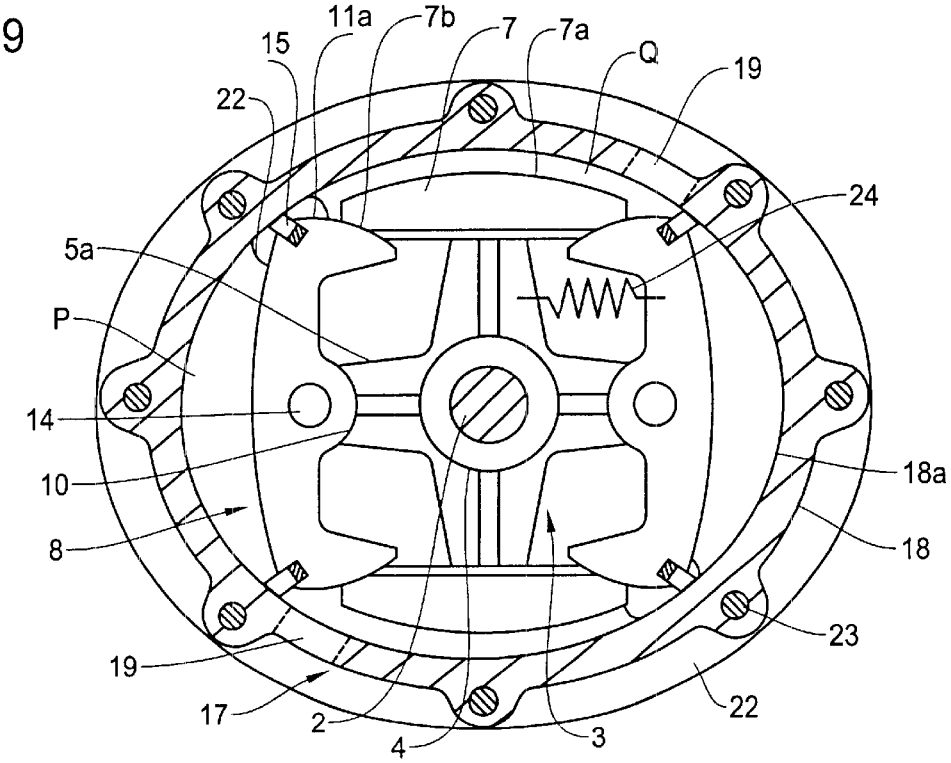
FIG. 9 is a diagram showing an inner state of the fluid machinery driven equipment of the present invention where the driven equipment is further rotated by 45 degrees from the condition of FIG. 8.

In this example, as best shown in FIGS. 7–9, the tubular casing 18 has intake openings (or exhaust openings) 19 at two symmetrical locations relative to the rotary shaft 2. Also seen in FIGS. 1 and 2–5, in this example, exhaust openings (intake openings) 22 are provided on caps or covers 20 of the rotary pump 17. Thus, when the openings 19 are used as intake ports, the openings 22 are used as exhaust ports, and vise versa.

The covers 20 are attached to the tubular casing 18 at the front and rear in the drawings, respectively, so that the inner surfaces of the covers 20 and the inner surface 18*a* of the tubular casing 18 create a cavity in the rotary pump 17. As best shown in the cross sectional views of FIGS. 4 and 5, each of the covers 20 has a shaft hole 21 to support the rotary shaft 2 which penetrates through the covers 20 at the front and back of the rotary pump 17. The covers 20 are attached to the tubular casing 18 through fastening members 23.

The inner surfaces of the covers 20 and the pistons 8 and the rotary plates 7 contact with one another in a slidable and airtight manner. Although not shown, air seals may be provided between the inner surfaces of the covers 20 and the pistons 8 and rotary plates 7 in case where a higher degree of airtightness is desired.

As noted above, in the example of FIGS. 1–9, the openings 22 to be used as either intake or exhaust ports are provided on the covers 20. Also noted above, the openings 19 to be used as either intake or exhaust ports are provided on the tubular casing 18. As shown in FIG. 1, the positional relationship between the openings 22 and the openings 19 are, for example, substantially right angle with each other with respect to the rotary shaft 2.

In FIG. 1, a spring 24 is provided between the arm 5*b* and the piston 8. The spring 24 exerts a relatively small spring force for functioning as a retaining spring. The purpose of the spring 24 is to assist the piston 8 to slide along the inner surface 18*a* when the rotor 3 rotates. Namely, in the high speed rotation of the driven equipment, a relatively large force of inertia is produced by the rotation of the piston 8, which results in the friction between the piston seals 15 and the inner surface 18*a* of the tubular casing 18. Therefore, the spring 24 is provided to reduce the friction by reducing the force of inertia by the small spring force.

Figure 6:
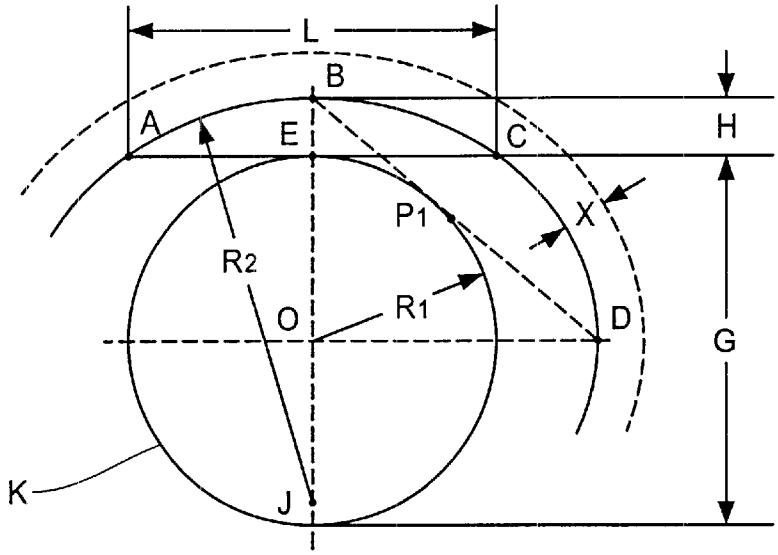
FIG. 6 is a schematic diagram for showing a basic principle of defining the inner shape of the fluid machinery driven equipment of the present invention.

FIG. 6 is a schematic diagram showing an dimensional relationship within the rotary pump of the present invention. The performance of the rotary pump (driven equipment) is dependent upon various parameters including an overall curve of the inner surface 18*a* and weight of the piston 8 since the piston 8 slides along the surface 18*a* while rotating about the piston pin 14 within predetermined angles. Thus, for improving the conversion efficiency, it is necessary for the piston 8 to smoothly slide along the inner surface 18*a* without generating a large inertia force.

The curve of the inner surface 18*a* of the tubular casing 18 is determined by the following procedure. First, a circle K having a radius R1 is illustrated. A tangential line AC having twice the length of the radius R1, i.e, a diameter L of the circle K is illustrated on the top point E of the circle K in a manner that the top point E and the center of the line AC contact each other.

A center point J is set on the line extended from the center point O of the circle K and the point E. An arc AC is illustrated from the point A to the point C with an arbitrary radius R2 where the crossing point of the arc AC and the extension of the line OE is denoted as a point B. Then, the point A is moved along the arc AC to the point B so that the point C is moved to the point D.

The circle K is a trace of the center of the piston pin 14 while the curve ABCD is a trace of the piston reference points as will be explained later with respect to the second embodiment of the present invention. The inner surface 18*a* of the tubular casing 18 is defined by the dotted line which is outwardly apart from the curve ABCD by a distance X.

In addition to distance X, FIG. 6 shows other parameters G and H. Here, H denotes a distance between the point B on the arc AC and the point E on the circle K. G denotes a diameter of the circle K. The inventor has found that the best performance of the rotary pump 17 is achieved when a ratio H/G is within a range approximately 0.12–0.19. When the ratio H/G is lower than 0.12, the amount of intake and exhaust is large, however, the inertia force of the rotation of the piston 8 increases. Such an increase in the inertia force causes knocking like problems and increases in friction in the rotary pump. This is because the rotation speed and rotation angle of the piston increase. In contrast, when the ratio H/G is higher than 0.19, the inertia force of the piston rotation decreases while also decreasing the amount of intake and exhaust.

The inventor has also found that in a production and reliability point of view, a ratio X/G is preferably within a range approximately 0.05–0.15. When the ratio X/G is smaller than 0.05, the rotary pump may not have enough mechanical strength and also be difficult in workmanship such as forming the piston seal. In contrast, when the ratio X/G is higher than 0.15, the overall size and weight of the rotary pump becomes unnecessarily large and heavy. In the preferred embodiment, the radius R1 is 50 mm, the length of line AC is 100 mm, and the distance X is 10 mm.

Based on the configuration in the foregoing, the rotary pump 17 of the present invention operate in the manner shown in FIGS. 7, 8 and 9. As shown in FIGS. 1 and 7–9, the spaces P is formed by the piston 8 and the inner surface 18*a*, and the space Q is formed by the rotary plate 7 and the inner surface 18*a*. Because the inner surface 18*a* of the tubular casing has the oval shape, the inner space P and the inner space Q are different from one another in capacity. The degree of difference in the space Q and the space P varies when the rotary pump 17 (the rotor 3) rotates about the rotary shaft 2. Here, it is assumed that the rotary pump 17 rotates in the counter-clockwise direction.

When the rotary pump 17 rotates to the position shown in FIG. 7, the space P is contracted to the minimum size (capacity), thereby exhausting the fluid, such as air, through the exhaust opening 19. On the other hand, the space Q is expanded to the maximum capacity, thereby intaking the fluid through the intake opening 22. This condition is identical to that shown in FIG. 1.

Next, FIG. 8 shows the situation where the rotary pump further rotates by 45 degrees in counter-clockwise from the condition shown in FIG. 7. In this condition, the space P increases from the minimum size of FIG. 7, thereby intaking the fluid through the intake opening 22. On the other hand, the space Q decreases from the maximum size of FIG. 7, thereby exhausting the fluid through the exhaust opening 19. As shown in FIG. 8, the inner shape of the rotary pump 17 changes by the rotation of the piston 8 about the pin 14 to accommodate the elliptical shape of the inner surface 18*a*. The coil spring 24 retains the piston 8 inwardly for reducing the friction between the seal 15 on the piston 8 and the inner surface 18*a*.

The positional relationship between the rotary plate 7 and the piston 8 changes by the rotation of the piston 8 to accommodate to the elliptical shape of the inner surface 18*a*. In FIG. 8, because of the rotation of the piston 8 about the piston pin 14, the contact position between the slide surface 11*a* of the piston 8 and the slide surface 7*b* of the rotary plate 7 changes significantly from that of FIG. 7. The seals 15 maintain the airtight contact with the inner surface 18*a* of the tubular casing 18.

FIG. 9 shows the situation where the rotary pump 17 of the present invention further rotates in the counter-clockwise direction by 45 degrees from the condition shown in FIG. 8. In this condition, the space P increases to the maximum to inhale the fluid from the intake opening 22, while exhausting the fluid through the exhaust opening 19. On the other hand, the space Q decreases to the minimum to exhale the fluid through the exhaust opening 19, while intaking the fluid through the intake opening 22.

In the foregoing, since the intake and exhaust cycle is performed in the two inner locations of the rotary pump during a quarter rotation, the rotary pump 17 of the present invention can achieve eight cycles of the intake and exhaust operations in one rotation.

As noted above, the seal 15 moves along the inner surface 18*a* of the tubular casing 18. The up and down motion of the seal 15 is controlled by the elastic member 16 so as to maintain the airtight contact between the piston 8 and the inner surface 18*a* of the tubular casing 18. The coil spring 24 with the small spring force assists the smooth rotation of the piston 8 so that the seal 15 at the edge of the piston 8 slides along the inner surface 18*a*.

Thus, the rotary pump of the present invention can intake and exhaust a large volume of fluid since one rotation thereof can perform eight cycles of the intake and exhaust operations. Moreover, the rotary pump of the present invention has a simple structure, which allows decrease in the size and cost. Further, the rotary pump of the present invention can be used for pumping any type of fluid such as liquid or gas.

FIGS. 10–14 show the second embodiment of the present invention with improved efficiency in the energy conversion. In the driven equipment of the first embodiment, the spring 24 is incorporated as shown in FIGS. 1 and 7–9. However, the resistance caused by the spring produces an energy loss in the driven equipment. To reduce the energy loss, the driven equipment of the second embodiment no longer uses the spring. The size and shape of the inner surface of the driven equipment is carefully designed to reduce the friction between the piston seal and the inner surface in the high speed rotation.

Further, in the second embodiment, both intake openings and exhaust openings are provided on the tubular casing. As seen in FIG. 1, in the first embodiment, either intake or exhaust openings are provided on the tubular casing while the other openings are provided on the cover. The inventor found that the efficiency of the driven equipment is improved when both the intake and exhaust openings are formed on the tubular casing. To further improve the efficiency, in the second embodiment, rotary plate seals are additionally provided on the rotary plates.

Figure 10:
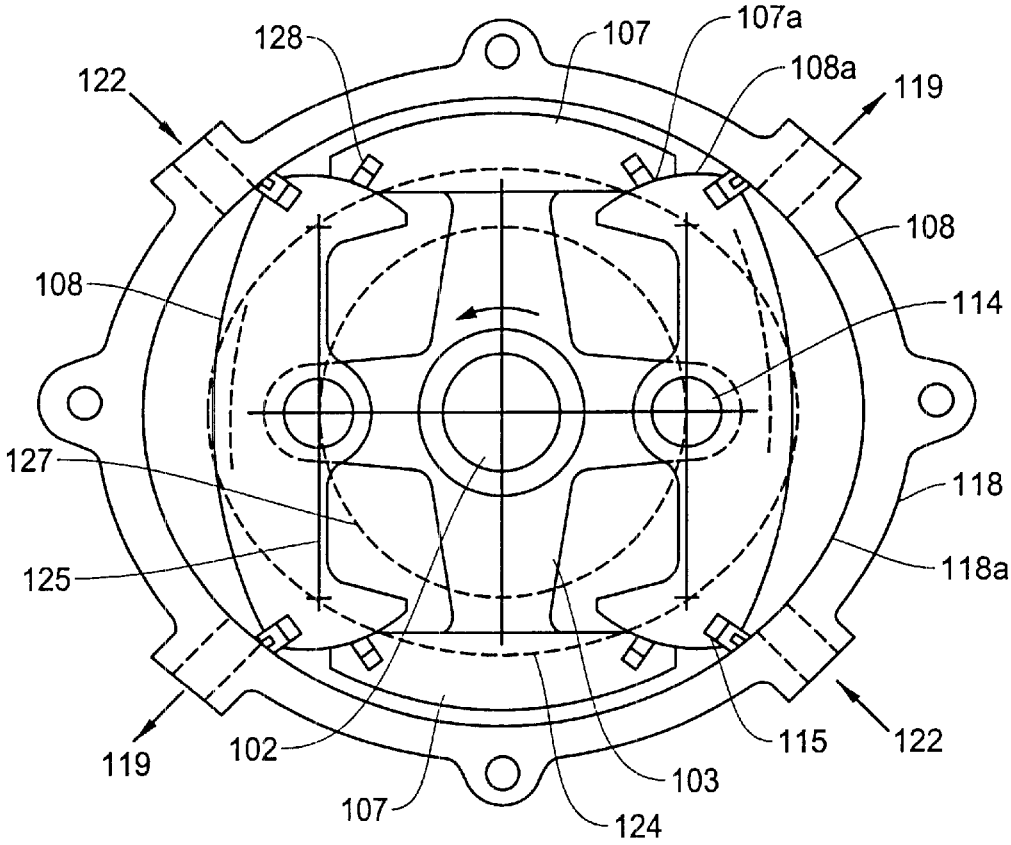
FIG. 10 is a front view showing the second embodiment of the fluid machinery driven equipment of the present invention.

FIG. 10 is a front view of the fluid machinery driven equipment having a tubular casing 118. Typically, the driven equipment is a rotary pump. In the center of the tubular casing 118, the rotary pump includes a rotary shaft 102 which is connected to a power transmission device (not shown). A rotor 103 is connected to the rotary shaft 102. The rotor 103 has rotary plates 107 and pistons 108 at ends of arms in the same manner as described with respect to the first embodiment. The piston 108 is connected to each of the arms in a manner rotatable about a piston pin 114.

Outer surface of the piston 108 and an outer surface of the rotary plate 107 are outwardly curved in a small degree. Both ends of the piston 108 are inwardly bent to form curved outer surfaces 108*a*. Inner surfaces 107*a* of the rotary plates 107 and the outer surfaces 108*a* of the piston 108 slidably contact with one another. To maintain the airtightness between the piston 8 and the rotary plate 107, as shown in FIG. 10, rotary plate seals 128 are provided on the rotary plate 107. The rotary plate seals 128 are elastic seals formed in the grooves on the rotary plate 107 in a similar manner described with respect to the piston seals 15 in the first embodiment. Further, in the same manner as described in the first embodiment, piston seals 115 are provided on the pistons 108 as shown in FIG. 10.

The tubular casing 118 and the inner surface 118*a* thereof have an oval shape so that the diameter in the right/left direction is larger than that of the up/down direction in FIG. 10. Therefore, the inner space in the right and left positions in the rotary pump of FIG. 10 is larger than the inner space in the up and down positions in the rotary pump. The tubular casing 118 has exhaust openings (or intake openings) 119 at two symmetrical locations relative to the rotary shaft 102 and intake openings (or exhaust openings) 122 at two symmetrical locations relative to the rotation shaft. The openings 119 and openings 122 are about 90 degrees apart from one another with respect to the rotation shaft 102.

In FIG. 10, a curve 127 (dotted line) indicates a trace of the center of the piston pin 114, and a curve 124 (dotted line) indicates a reference casing curve which is a trace of reference points of the piston 108. The reference points of the piston 108 are determined by the corners of a square in which each side of the square has a length equal to the distance between the centers of the piston pins 114.

Figure 11:
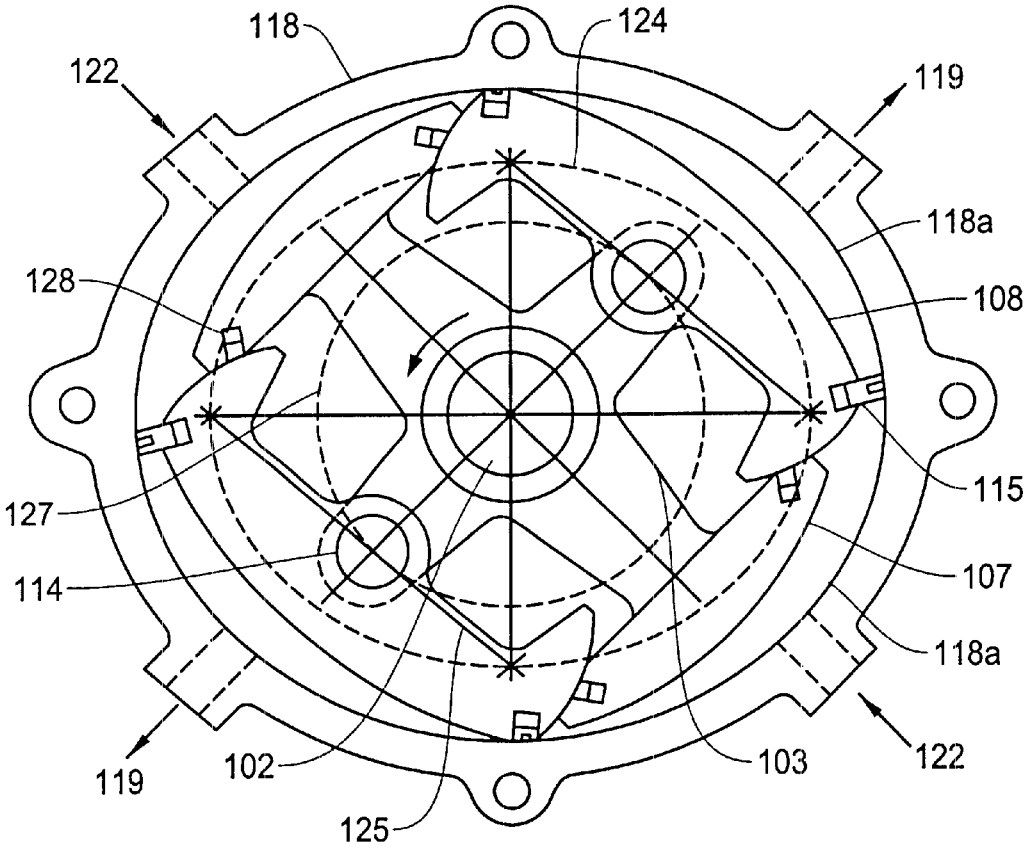
FIG. 11 is a front view showing the second embodiment of the present invention where the driven equipment is rotated by 45 degrees from the state of FIG. 10.
Figure 12:
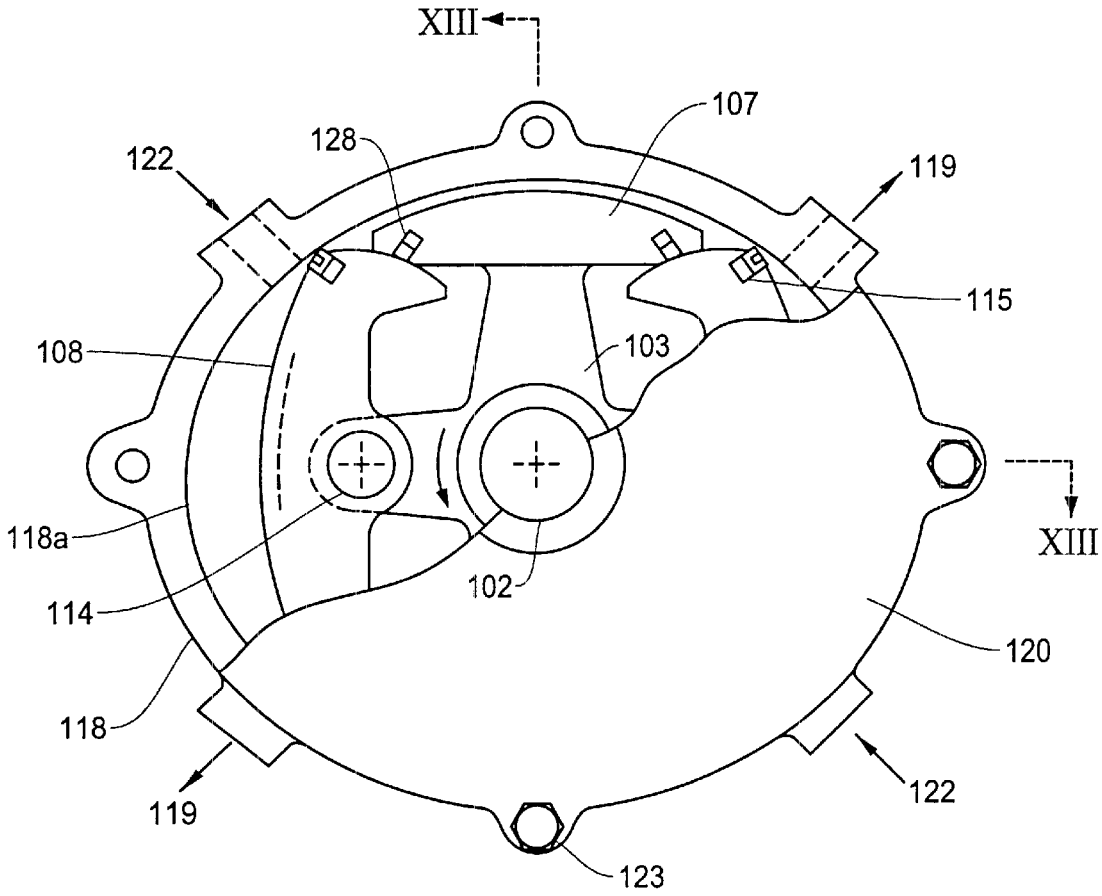
FIG. 12 is a partially cut-out front view showing the second embodiment of the fluid machinery driven equipment of the present invention having a cover.
Figure 13:
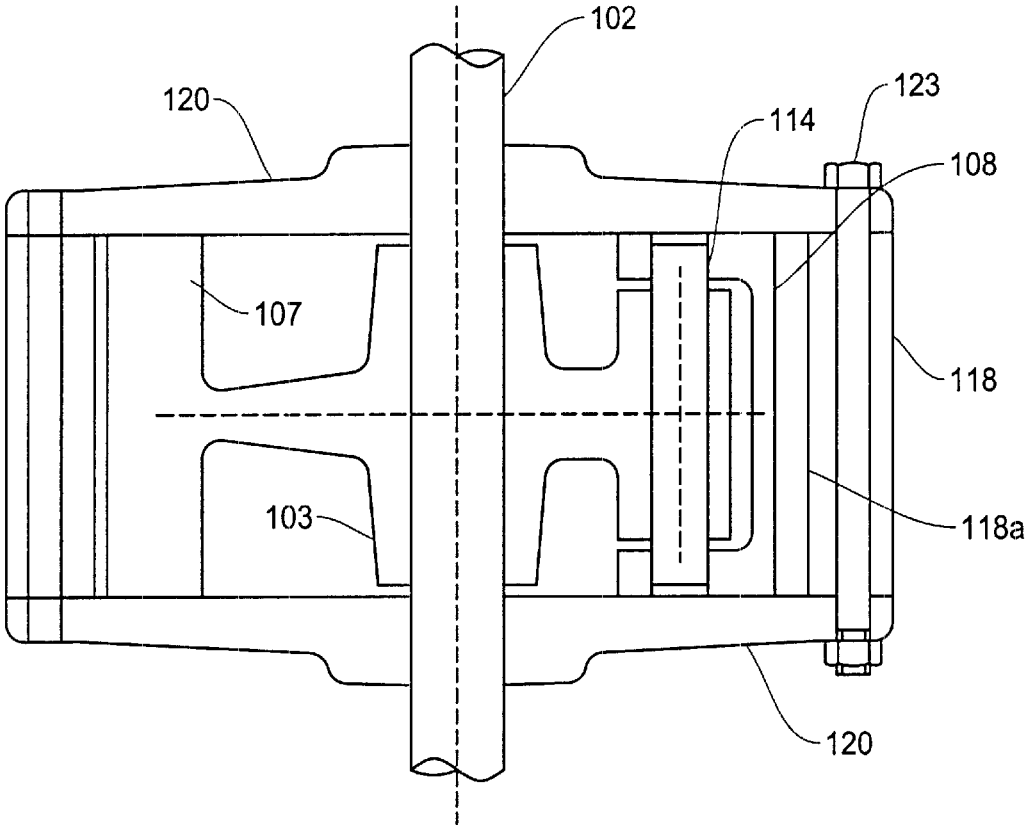
FIG. 13 is a cross sectional view showing the second embodiment of the fluid machinery driven equipment of the present invention taken along a line XIII-Xiii of FIG. 12.

When the rotor 103 rotates by 45 degrees in the counterclockwise direction, the rotary plates 107 and the pistons 108 are positioned in the manner shown in FIG. 11. As shown in FIGS. 12 and 13, covers 120 are attached to the tubular casing 118 at the front and rear, respectively, so that inner surfaces of the covers 120 and the inner surface 118*a* of the tubular body 118 create a cavity in the rotary pump. The covers 120 are attached to the tubular casing 118 through fastening members 123, for example. Although not shown, air seals may be provided between the inner surfaces of the covers 120 and the pistons 108 and rotary plates 107.

Figure 14:
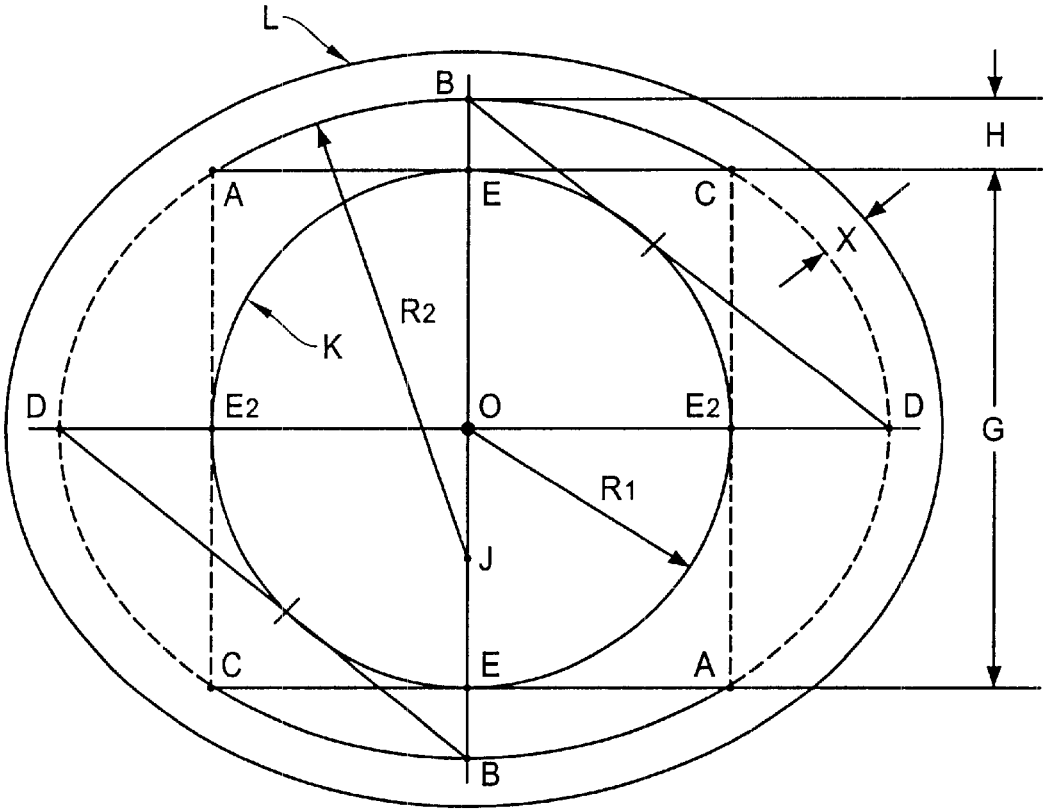
FIG. 14 is a schematic diagram for showing a basic principle of defining the inner structure of the fluid machinery driven equipment of the present invention.

FIG. 14 is a schematic diagram for showing a basic principle of defining the inner shape of the rotary pump of the present invention. As noted above with reference to FIG. 6, the performance of the rotary pump (driven equipment) is dependent upon various parameters including an overall curve of the inner surface and weight of the piston since the piston slides along the surface 18*a* while rotating about the piston pin within predetermined angles. Thus, for improving the conversion efficiency, it is necessary for the piston to smoothly slide along the inner surface without generating a large inertial force.

The curve of the inner surface 118*a* of the tubular casing 118 is determined by the following procedure. First, a circle K having a radius R1 is illustrated. The circle K corresponds to the curve 127 of FIGS. 10 and 11 which is the trace of the piston pin 114. A tangential line AC having twice the length of the radius R1, i.e, a diameter L of the circle K is illustrated on the top point E of the circle K in a manner that the top point E and the center of the line AC contact each other. A center point J is set on the line extended from the center point O of the circle K and the point E. An arc AC is illustrated from the point A to the point C with an arbitrary radius R2 where the crossing point of the arc AC and the extension of the line OE is denoted as a point B.

Then, the point A of the line AB is moved along the arc AC to the point B so that the point C is moved to the point D, thereby forming a curve ABCD. The curve ABCD corresponds to the curve 124 of FIG. 10 which is the reference casing curve. As noted above, the reference casing curve is the trace of reference points of the piston 108. The reference points of the piston 108 are determined by the corners of the square where each side of square has a length equal to the distance between centers of the piston pins 114. The inner surface 118*a* of the tubular casing 118 is defined by the outermost curve L which is apart from the curve ABCD by a distance X.

Further in FIG. 14, similar to the example of FIG. 6, H denotes a distance between the point B on the arc AC and the point E on the circle K. G denotes a diameter of the circle K. For the best performance of the rotary pump 17, it is preferable that a ratio H/G is set within a range approximately 0.12–0.19. When the ratio H/G is lower than 0.12, the amount of intake and exhaust is large, however, the inertia force of the rotation of the piston 108 increases. Such an increase in the inertia force causes knocking like problems and also increases in friction in the rotary pump. In contrast, when the ratio H/G is higher than 0.19, the inertia force of the piston rotation decreases while also decreasing the amount of intake and exhaust.

For mechanical strength and ease of design, it is preferable that a ratio X/G is set within a range approximately 0.05–0.15. When the ratio X/G is smaller than 0.05, the rotary pump may not have enough mechanical strength and also be difficult in workmanship such as forming the piston seal. In contrast, when the ratio X/G is higher than 0.15, the overall size and weight of the rotary pump becomes unnecessarily large and heavy.

Although only a preferred embodiment is specifically illustrated and described herein, it will be appreciated that many modifications and variations of the present invention are possible in light of the above teachings and within the purview of the appended claims without departing the spirit and intended scope of the invention.

What is claimed is:

1. A driven equipment for fluid machinery which is driven by an external force, comprising:

a tubular casing having an inner surface which is substantially elliptic in shape;

a rotor provided in the tubular casing, the rotor having a first arm provided with a rotatable piston at its end and a second arm in perpendicular to the first arm provided with a rotary plate at its end;

wherein the rotatable piston slides along the inner surface of the tubular casing while rotating within predetermined angles when the rotor rotates; and wherein the elliptical shape of the inner surface of the tubular casing is determined by the following steps of:

(1) drafting a circle K with a radius R1 with respect to a center O;

(2) drafting a straight line AC which is tangential to the circle K at a center point E of the line AC;

(3) extending a line EO and drafting an arc ABC with respect to a center J on the line EO with a radius R2, where a point B is a cross point of the line EO and the arc ABC;

(4) moving the point A of the straight line AC along the arc ABC to the point B in a manner that the center E moves along the circle K, and drafting the trace of the point C of the line AC to form a curve ABCD; and (5) defining an outer curve which is apart from the curve ABCD by a distance X;

wherein the outer curve is the inner surface of the tubular casing, and wherein a ratio H/G is within about 0.12–0.19 where H is a distance between the points B and E, and G is a diameter of the circle K.

2. A driven equipment as defined in claim 1, further comprising:

front and rear covers for covering the tubular casing through fastening means; and a rotary shaft provided in the tubular casing and connected to the rotor, at least one end of the rotary shaft being projected from the tubular casing to be connected to the external force.

3. A driven equipment as defined in claim 2, wherein said first arm is extended from a center of the rotor to opposite directions;

wherein said piston is connected to each end of the first arm through a piston pin and is formed a "T" shape with the first arm and having an outwardly curved surface, and each end of the piston having an inwardly bent portion;

wherein said second arm extended from the center of the rotor to opposite directions in perpendicular to the first arm; and wherein said rotary plate is provided at each end of the second arm and is formed a "T" shape with the second arm and having an outwardly curved surface, and an inner surface at each end of the rotary plate slidably contacting an outward surface of the inwardly bent portion of the piston.

4. A driven equipment as defined in claim 3, further comprising:

piston seals elastically formed on the piston at around both edges thereof for air tightly contacting the inner surface of the tubular casing; and a spring provided between the second arm and the piston for reducing frictional forces between the piston seals and the inner surface of the tubular casing.

5. A driven equipment as defined in claim 3, further comprising:

piston seals elastically formed on the piston at around both edges thereof for air tightly contacting the inner surface of the tubular casing; and rotary plate seals elastically formed on the rotary plates on the inner surfaces thereof for air tightly contacting between the pistons and the rotary plates.

6. A driven equipment for fluid machinery as defined in claim 3, further comprising:

first openings provided on the tubular casing at two positions which are symmetrical with one another relative to the rotary shaft; and second openings provided on the tubular casing at two positions which are symmetrical with one another relative to the rotary shaft and about 90 degrees apart from the first openings;

wherein when the first openings function as intake openings, the second openings function as exhaust opening, and vice versa.

7. A driven equipment for fluid machinery as defined in claim 3, wherein four spaces are created by the inner surface of the tubular casing and the rotor, two of the spaces are formed by the pistons at both ends of the first arm and the inner surface, and two other spaces are formed by the rotary plates at both ends of the second arm and the inner surface, wherein the sizes of the four spaces change by rotation of the rotor, thereby performing intake and exhaust actions for fluid.

8. A driven equipment for fluid machinery which is driven by an external force, comprising:

a tubular casing having an inner surface which is substantially elliptic in shape;

a rotor provided in the tubular casing, the rotor having a first arm provided with a rotatable piston at its end and a second arm in perpendicular to the first arm provided with a rotary plate at its end;

wherein the rotatable piston slides along the inner surface of the tubular casing when the rotor rotates; and wherein the elliptical shape of the inner surface of the tubular casing is determined by the following steps of:

(1) drafting a circle K with a radius R1 with respect to a center O;

(2) drafting a straight line AC which is tangential to the circle K at a center point E of the line AC;

(3) extending a line EO and drafting an arc ABC with respect to a center J on the line EO with a radius R2, where a point B is a cross point of the line EO and the arc ABC; and (4) moving the point A of the straight line AC along the arc ABC to the point B in a manner that the center E moves along the circle K, and drafting the trace of the point C of the line AC to form a curve ABCD;

(5) defining an outer curve which is apart from the curve ABCD by a distance X;

wherein the outer curve is the inner surface of the tubular casing, and wherein a ratio X/G is within about 0.05–0.15, where G is a diameter of the circle K.

9. A driven equipment as defined in claim 8, further comprising:

front and rear covers for covering the tubular casing through fastening means; and a rotary shaft provided in the tubular casing and connected to the rotor, at least one end of the rotary shaft being projected from the tubular casing to be connected to the external force.

10. A driven equipment as defined in claim 9, wherein said first arm is extended from a center of the rotor to opposite directions;

and wherein said piston is connected to each end of the first arm through a piston pin and is formed a "T" shape with the first arm and having an outwardly curved surface, and each end of the piston having an inwardly bent portion;

and wherein said second arm extended from the center of the rotor to opposite directions in perpendicular to the first arm; and wherein said rotary plate is provided at each end of the second arm and is formed a "T" shape with the second arm and having an outwardly curved surface, and an inner surface at each end of the rotary plate slidably contacting an outward surface of the inwardly bent portion of the piston.

11. A driven equipment as defined in claim 10, further comprising:

piston seals elastically formed on the piston at around both edges thereof for air tightly contacting the inner surface of the tubular casing; and a spring provided between the second arm and the piston for reducing frictional forces between the piston seals and the inner surface of the tubular casing.

12. A driven equipment as defined in claim 10, further comprising:

piston seals elastically formed on the piston at around both edges thereof for air tightly contacting the inner surface of the tubular casing; and rotary plate seals elastically formed on the rotary plates on the inner surfaces thereof for air tightly contacting between the pistons and the rotary plates.

13. A driven equipment for fluid machinery as defined in claim 10, further comprising:

first openings provided on the tubular casing at two positions which are symmetrical with one another relative to the rotary shaft; and second openings provided on the tubular casing at two positions which are symmetrical with one another relative to the rotary shaft and about 90 degrees apart from the first openings;

wherein when the first openings function as intake openings, the second openings function as exhaust opening, and vice versa.

14. A driven equipment for fluid machinery as defined in claim 10, wherein four spaces are created by the inner surface of the tubular casing and the rotor, two of the spaces are formed by the pistons at both ends of the first arm and the inner surface, and two other spaces are formed by the rotary plates at both ends of the second arm and the inner surface, wherein the sizes of the four spaces change by rotation of the rotor, thereby performing intake and exhaust actions for fluid.

15. A driven equipment for fluid machinery which is driven by an external force, comprising:

a tubular casing having an inner surface which is substantially elliptic in shape;

a rotor provided in the tubular casing, the rotor having a first arm provided with a rotatable piston at its end and a second arm in perpendicular to the first arm provided with a rotary plate at its end;

wherein the rotatable piston slides along the inner surface of the tubular casing when the rotor rotates; and wherein the elliptical shape of the inner surface of the tubular casing is determined by the following steps of:

(1) drafting a circle K with a radius R1 with respect to a center O;

(2) drafting a straight line AC which is tangential to the circle K at a center point E of the line AC;

(3) extending a line EO and drafting an arc ABC with respect to a center J on the line EO with a radius R2, where a point B is a cross point of the line EO and the arc ABC; and (4) moving the point A of the straight line AC along the arc ABC to the point B in a manner that the center E moves along the circle K, and drafting the trace of the point C of the line AC to form a curve ABCD;

(5) defining an outer curve which is apart from the curve ABCD by a distance X;

wherein the outer curve is the inner surface of the tubular casing, and wherein a ratio X/G is within about 0.05–0.15 and a ratio H/G is within about 0.12–0.19, where H is a distance between the points B and E, and G is a diameter of the circle K.

* * * * *